United States Patent [19]

Rueff

[11] Patent Number: 5,015,357

[45] **Date of Patent: * May 14, 1991**

[54] WAX SWEATING

[75] Inventor: Roger M. Rueff, Naperville, Ill.

[73] Assignee: Amoco Corporation, Chicago, Ill.

[ * ] Notice: The portion of the term of this patent subsequent to Apr. 25, 2006 has been disclaimed.

[21] Appl. No.: 320,520

[22] Filed: Mar. 7, 1989

Related U.S. Application Data

[63] Continuation-in-part of Ser. No. 140,472, Jan. 4, 1988 Pat. No. 4,824,553

[51] Int. Cl.[5] ..... C10G 43/04

[52] U.S. Cl. ..... 208/32; 208/30

[58] Field of Search ..... 208/32, DIG. 1, 30

[56] References Cited

U.S. PATENT DOCUMENTS

| | | | |
|---|---|---|---|
| 2,099,683 | 11/1937 | Ferris et al. | 208/32 |
| 2,406,210 | 8/1946 | Ferris | 208/32 |
| 2,658,856 | 11/1953 | Perry et al. | 208/32 |
| 2,721,165 | 10/1955 | Roberson et al. | 208/32 |
| 3,142,632 | 7/1964 | Sigualt et al. | 208/32 |
| 4,013,541 | 3/1977 | Irwin et al. | 208/32 |
| 4,824,553 | 4/1989 | Rueff | 208/32 |

*Primary Examiner*—Helane E. Myers

*Attorney, Agent, or Firm*—Thomas W. Tolpin; William H. Magidson; Ralph C. Medhurst

[57] ABSTRACT

An early meltdown process of wax sweating is provided which enhances the efficiency, quality, product yield, and throughput of wax. In the early meltdown process, slack wax is crystallized. The crystallized was is then sweated while simultaneously draining the liquid drippings from the sweating oven. The congealing point of the liquid drippings are monitored. When the congealing point of the liquid drippings indicate that the melting temperature of the desired wax product has been obtained, sweating and drainage are stopped, and the remaining solid bed of wax in the sweating oven is rapidly melted and subsequently upgraded.

10 Claims, 5 Drawing Sheets

WAX SWEATING

CROSS REFERENCES TO RELATED APPLICATIONS

This patent application is a continuation-in-part of the patent application of Roger M. Rueff, Ser. No. 140,472, filed Jan. 4, 1988, entitled: Wax Sweating, presently pending before Examiner G. Caldarola, Group Art Unit 116.

BACKGROUND OF THE INVENTION

This invention relates to wax and, more particularly to wax sweating.

Wax is useful for candles and many other products, such as wax paper, crayons, coatings for paper cups, corrugated cardboard containers, board sizing, mold releases, base stock for pour point depressants, etc.

Petroleum wax is primarily comprised of branched and straight-chain paraffins. Paraffin wax is often present in intermediate and heavy oils and separates upon cooling. The removal of paraffin wax is desirable to obtain lubricating oils with satisfactory low pour points. The main product of the dewaxing process is a dewaxed oil with the desired pour point and the by-product is slack wax. The wax produced in the dewaxing step can be deoiled and upgraded to produce saleable wax, such as food grade wax. In the past, wax was mainly considered as a by-product of dewaxing of lubricating oils and lubricants. Today, wax is itself a valuable product.

Slack wax can be deoiled by sweating or solvent dewaxing. Wax sweating is the least common method in use today. During conventional wax sweating, a warm liquid oil-wax mixture, called "slack wax," is chilled to a semisolid state. Oil is entrapped in the solid wax. The solid wax is subsequently slowly heated in a sweating oven, pan sweater, tank, furnace, or heat exchanger. During sweating, the temperature of the wax in the oven is slowly raised to liquify part of the wax. The liquid wax is referred to as liquid drippings and comprises wax and oil. The initial liquid drippings are relatively rich in oil.

During sweating, the liquid drippings are continuously drained from the oven. The remaining solid wax in the oven is leaner in oil. As sweating continues, the oil content of the bed of solid wax remaining in the oven decreases and the melting temperature of the solid wax increases. Concurrently, the oil content of the liquid drippings decreases and the melting point of the liquid drippings increases. Significantly, the oil and wax contents of the liquid drippings are substantially different than the oil and wax contents of the bed of solid wax remaining in the oven.

A typical sweating oven comprises a vertical, shell and tube heat exchanger. Wax from the lube oil dewaxing units is charged as a liquid to the shell side of the oven, then solidified by running cold water through the tube side. After the wax sets up, the water is heated at a specified rate over a period of many days. As the oven warms, the wax begins to melt. The first liquid fractions to drain from the bed through the rundown line have the lowest melting point and contain the most oil. Conversely, the last liquid to come from the bed has the highest melting point and the least amount of oil. The liquid drippings collect in the bottom of the oven and drain into pans. As each pan becomes full, the wax in the pan is typically tested for its congealing point and oil content. The results of this analysis determine whether the wax in the pan is pumped to Foots oil for catalytic cracker feed, intermediate tankage to be resweat in another sweating oven, or to hi-fi feed storage to be processed as finished wax. The sweating process continues until all of the wax in the oven has been melted and collected in the pans.

In conventional practice, sweating continues until all of the wax has been melted from the bed. Unfortunately, it is very difficult to control the quality and composition of the actual wax product. It is determined in part by the size of the pans and the oil content of the charge wax.

It is currently impracticable to remove and analyze samples of the wax remaining in the sweating oven at intervals during the process, not only because of the inaccessibility of the wax in the oven, but also because samples taken from any particular location in the sweater are not necessarily representative of the remainder of the wax. It is, therefore, the usual practice to analyze successive samples of the liquid drippings in the drip pans.

One prior art method employed comprises pouring a sample of the liquid drippings into a melting-point wax bath, allowing it to cool and solidify so that a cake of wax is formed. The cake is then observed under light. If the operator observes a greenish tinge, it indicates to him that the wax in the sweating oven needs further sweating.

In the method of U.S. Pat. No. 2,721,165, sweat streams are sampled by passing ultraviolet light of a wavelength between 240 and 350 millimicrons through the sweat streams until the observed absorptivity of the sampled sweat streams reach a value which corresponds to a predetermined oil content of the wax in the sweater, based upon a correlation of the oil content of the wax and the absorptivity of the sweat streams. Once the selected value is reached, sweating is terminated.

Over the years a variety of methods have been suggested for processing wax, oil, or other products. Typifying some of these prior art methods are those shown in U.S. Pat. Nos. 2,099,683; 2,658,856; 2,406,210; 3,142,632; and 4,013,541. These prior art methods have met with varying degrees of success.

It is, therefore, desirable to provide an improved method of wax sweating.

SUMMARY OF THE INVENTION

An improved method of wax sweating is provided which is effective, efficient, and economical. The improved method of wax sweating is also referred to as the early meltdown method of wax sweating. Advantageously, the early meltdown method of wax sweating greatly reduces the time required to sweat wax and improves product quality and yield. It also allows refineries and other manufacturers to accurately produce the type of wax products they want and increase wax production.

To this end, the novel wax sweating process includes: crystallizing the wax, sweating and fractionating the wax until the wax contains less than a selected amount of oil, melting the sweated wax, and optionally hydrofinishing the wax. Desirably, sweating is continued until the wax has reached a preselected melting temperature or the oil has reached a specified limit.

Desirably, molten slack wax containing oil is solidified to crystallize the wax and entrap (encase) the oil in the solid wax. The wax is then sweated by gradually and progressively heating the solidified wax in a sweating oven to at least the melting temperature of part of the wax to produce sweated wax containing less oil than the molten wax. Simultaneously, liquid drippings, comprising some of the oil and melted wax, are withdrawn from the sweating oven.

The relationship of the ASTM melting of the remaining solidified wax in the sweating oven is determined as a function of the congealing point of the liquid drippings and the efficiency of the sweating oven by calculating such relationship, such as on a calculator or computer, or graphing such relationship, such as on a nomograph. The congealing point and/or ASTM melting point of the melted wax in the liquid drippings are monitored, either continuously or at frequent intervals, in order to determine the ASTM melting point of the solid bed of remaining wax in the sweating oven. Such monitoring can be done manually with a thermometer, or automatically with a thermocouple and a computer or other central processing unit.

Deoiling (sweating) and withdrawal (draining) of the wax are stopped once the desired ASTM melting point of the solid bed of wax remaining in the sweating oven has been reached. Thereafter, the sweating oven is heated to liquify the sweated solid bed of wax remaining in the oven, without further deoiling, separating, or fractionating liquid drippings from the sweated bed. The liquified sweated bed comprising the wax product is discharged and drained from the sweating oven and collected in a container, such as a pan, vessel, tank, bin, receptacle, pipe, drum, or kettle.

The proportion of oil in the liquid drippings and in the bed of wax can be determined by comparing the congealing point of the liquid drippings with the oil content on a special oil-wax (solid-liquid) phase diagram. The ASTM melting point of the bed of wax remaining in the sweating oven can be derived on the oil-wax phase diagram based upon the desired oil content of the product wax. Preferably, the ASTM melting point of the solid bed of wax is determined by intersecting the monitored congealing point of the liquid drippings with the ASTM melting point of the target (desired) wax product on a nomograph comprising a diagram of the wax sweating efficiency or liquid holdup of the sweating oven, which can be calculated based upon the mass of the solid wax.

The oil-wax phase diagram can be constructed by measuring the oil content of the liquid and solid wax in equilibrium or by measuring the onset and peak maximum temperatures for waxes of different oil contents. An oilwax phase diagram can also be constructed after measuring the melting point and congealing point of the wax with a differential scanning calorimeter along with measuring the ultraviolet absorbance of the wax at different settings.

As used in this patent application, the terms "sweat" and "sweating" mean to separate, fractionate, and remove oil and liquid wax from a substantially solid bed of wax.

The term "sweating oven" as used herein includes one or more of the following: a pan sweater, tank, furnace, oven, or heat exchanger.

A more detailed explanation of the invention is provided in the following description and appended claims taken in conjunction with the accompanying drawings.

DETAILED DESCRIPTION OF THE PREFERRED EMBODIMENT

Figure 1:
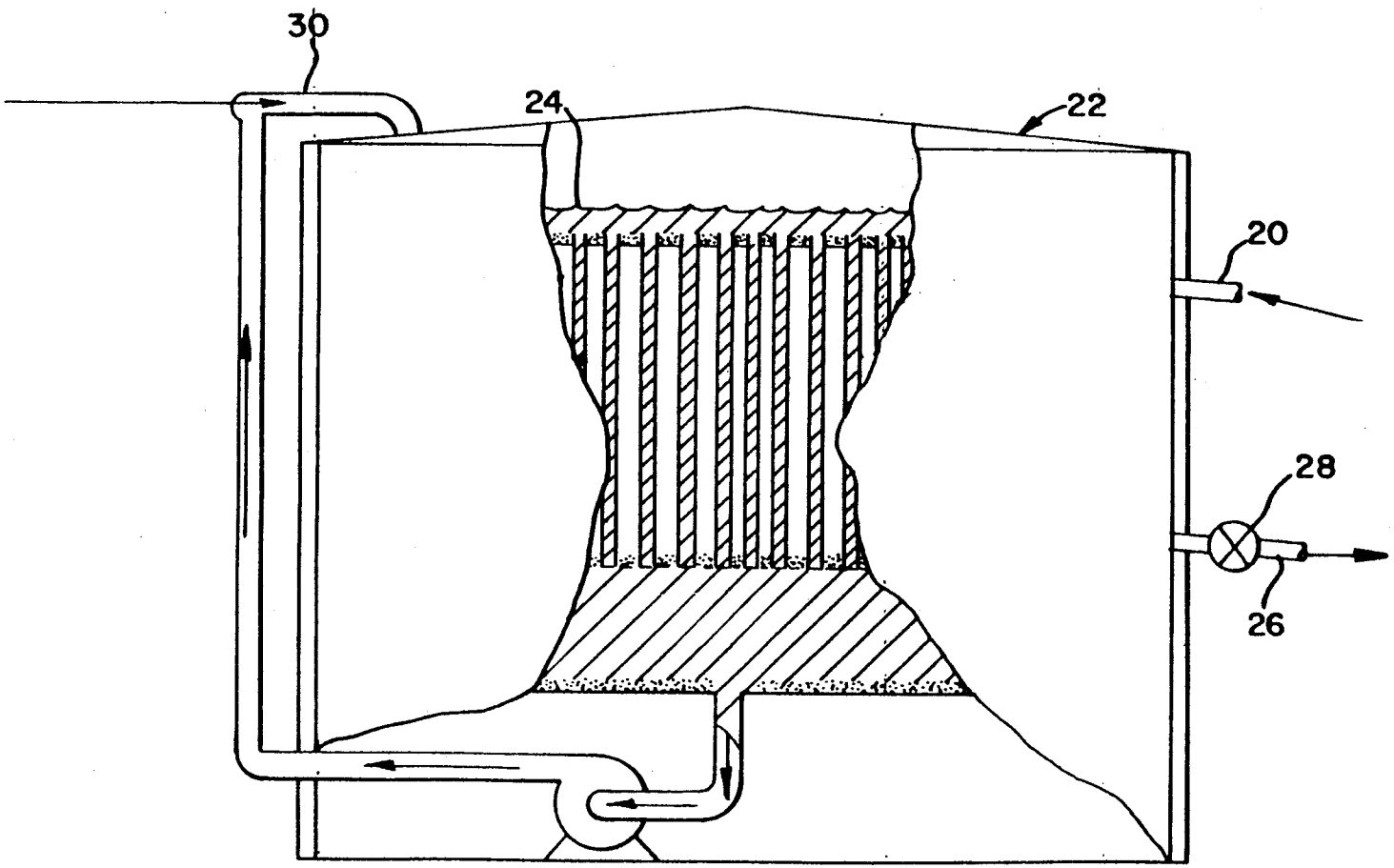
FIG. 1 is a cross-sectional view of a sweating oven.

In the preferred process, a bed of sweatable molten slack wax, comprising branched and straight chain paraffins, is charged (fed) through a feed line 20 (FIG. 1) into a sweating oven 22 comprising a vertical, shell and tube, heat exchanger. The slack wax is cooled to a solidification temperature ranging from about 50° F. to about 80° F., preferably from about 60° F. to about 70° F., by circulating cold water through the exchanger tubes 24 until all the high and intermediate melt point components in the slack wax have solidified and crystallized. The bed of solid crystallized wax is then sweated, fractionated, partially liquified, and deoiled by progressively heating the bed of wax in the sweating oven 22 for many days at a rate ranging from about 0.5° F./hr. to about 2° F./hr. to at least the melting point of some of the wax.

As the bed of solid wax is heated in the sweating oven 22 (FIG. 1), the bed softens, and the lower melting point materials in the wax liquify. Such softening releases oil trapped in the wax cake (bed) pores. The released (sweated) free oil combines with low melting point wax and becomes the first liquid (liquid drippings or sweat) to leave the bed of solid wax. The first liquid drippings to drain from the bed through the rundown line or drain line 26 have the lowest melting point and contain the most oil.

During sweating, the liquified wax rundown valve 28 (FIG. 1) of the sweating oven 22 is opened, and the liquid drippings comprising liquid wax and oil are continuously drained and removed from the sweating oven 22 through the wax rundown line 26 into wax retention pans or drip pans. Samples of the liquid drippings are frequently tested and analyzed to determine their oven drip congealing points or ASTM melting points. Preferably, this is accomplished by: placing some of the removed liquified wax from the pans on a thermometer, rotating the thermometer until the liquid wax begins to congeal, and observing the congealing temperature (congealing point) on the thermometer.

As sweating progresses, the oil content of the liquid drippings decreases, as does the oil content in the bed of solid wax remaining in the sweating oven 22. Concurrently, as sweating progresses, the congealing points and ASTM melting points of the liquid drippings increase, as does the ASTM melting point of the bed of solid wax remaining in the sweating oven 22.

Figure 2:
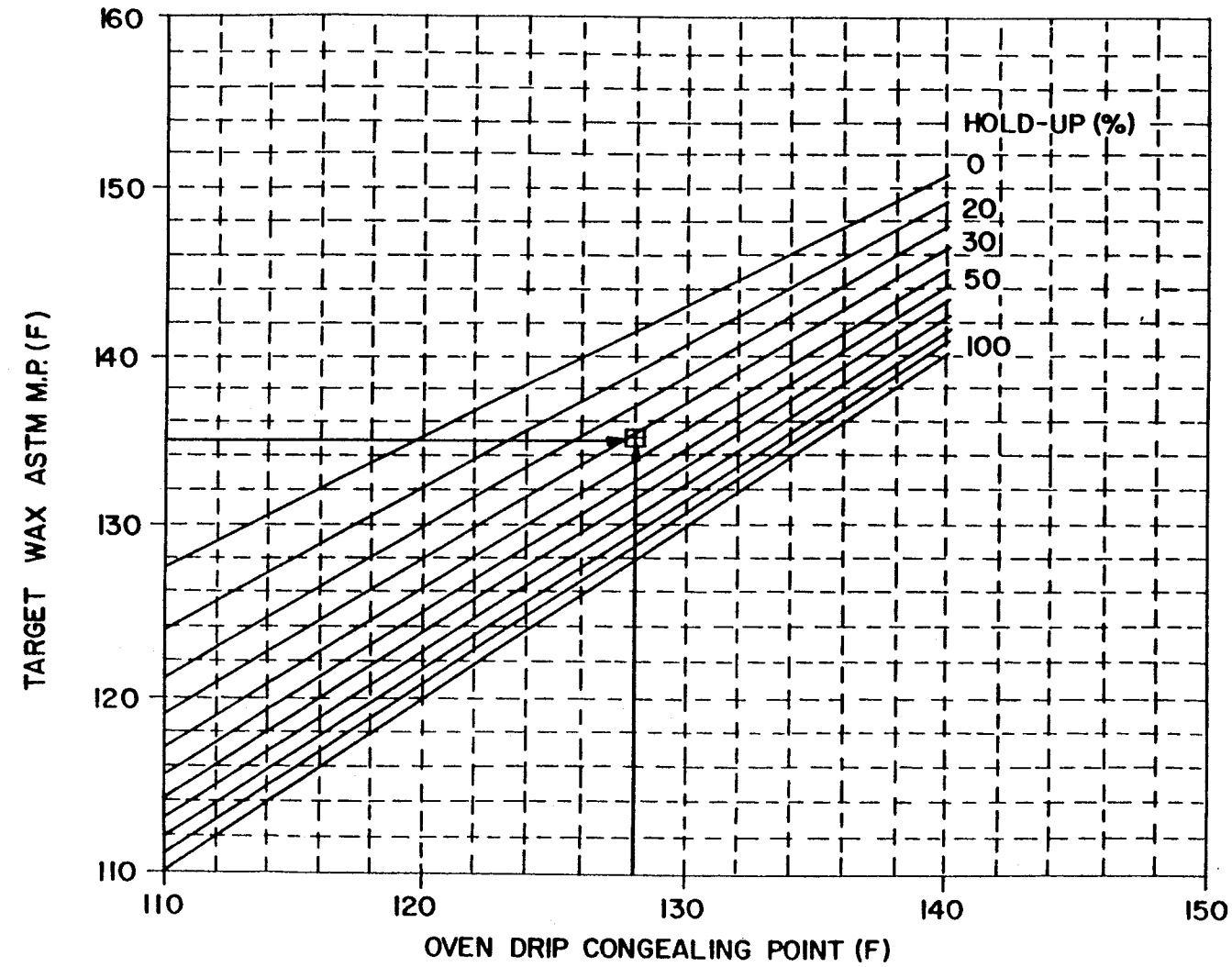
FIG. 2 is a nomograph of the liquified wax holdup and sweating efficiency of various sweating ovens, the oven drip congealing point of the liquid drippings, and the ASTM melting point of the target wax product.

The ASTM melting point of the bed of solid wax remaining in the oven 22 (FIG. 1) during sweating is continuously monitored and preferably determined by linearly intersecting the oven drip congealing point of the sample liquified wax from the pan with a plot of the liquified wax holdup and sweating efficiency on a nomograph, such as shown in FIG. 2. When the monitored ASTM melting point of the bed of solid wax remaining in the sweating oven 22 (FIG. 1) has reached a desired level, the liquified wax rundown valve 28 in the sweating oven 22 is closed to block further separate drainage and removal of liquid drippings and sweating (deoiling) is stopped. The last liquid drippings to be sweated from the bed has the highest melting point and is the liquid with the least amount of oil. The data shown in FIGS. 2–5 can also be calculated and electronically stored on a computer or other central processing unit for later comparison, analysis, and retrieval.

After the liquified wax rundown valve 28 (FIG. 1) has been closed, the bed of solid wax is completely melted and liquified at a much faster rate by injecting steam through one or more steam lines 30 into the sweating oven 22. The melted wax is subsequently mixed, drained through rundown line 26, after opening rundown valve 28, and pumped into wax retention pans as one continuous phase. The melted wax can be sampled to verify its ASTM melting point and oil content in a manner similar to sampling (testing) the liquid drippings described previously.

The melted wax can be pumped to storage. The melted wax is subsequently hydrofinished and upgraded to produce the desired finish wax product, preferably food grade wax, by contacting the melted wax with hydrogen in the presence of a hydrogenation catalyst in a hydrogenation vessel at a pressure ranging from about 140 psia to about 3675 psia, preferably from about 1900 psia to 1950 psia, and at a hydrogenation temperature ranging from about 400° F. to about 755° F., preferably not greater than 650° F. for best results.

The early meltdown method of wax sweating advantageously recognizes that the solid wax remaining in an oven is often low enough in overall oil content to be used as sweated product when the oven drips (liquid drippings) are still too high to be acceptable. This principle is best illustrated by the oil-wax phase diagram of FIG. 3. The oil-wax phase diagram comprises a solid region, a liquid region, and a region in which the solid and liquid phases coexist. Wax sweating takes place within the two-phase region. As best illustrated in the phase diagram of FIG. 3, at any given temperature, the solid wax phase contains less oil than its equilibrium liquid wax phase. The oil-wax phase diagram also shows that there is a direct correlation between sweated wax oil content and wax melting and congealing points. The solid/solid-liquid phase boundary curve, s(T), represents the true melting point of the wax. The liquid/-solid-liquid phase boundary curve, l(T), represents the true wax congealing point.

Figure 3:
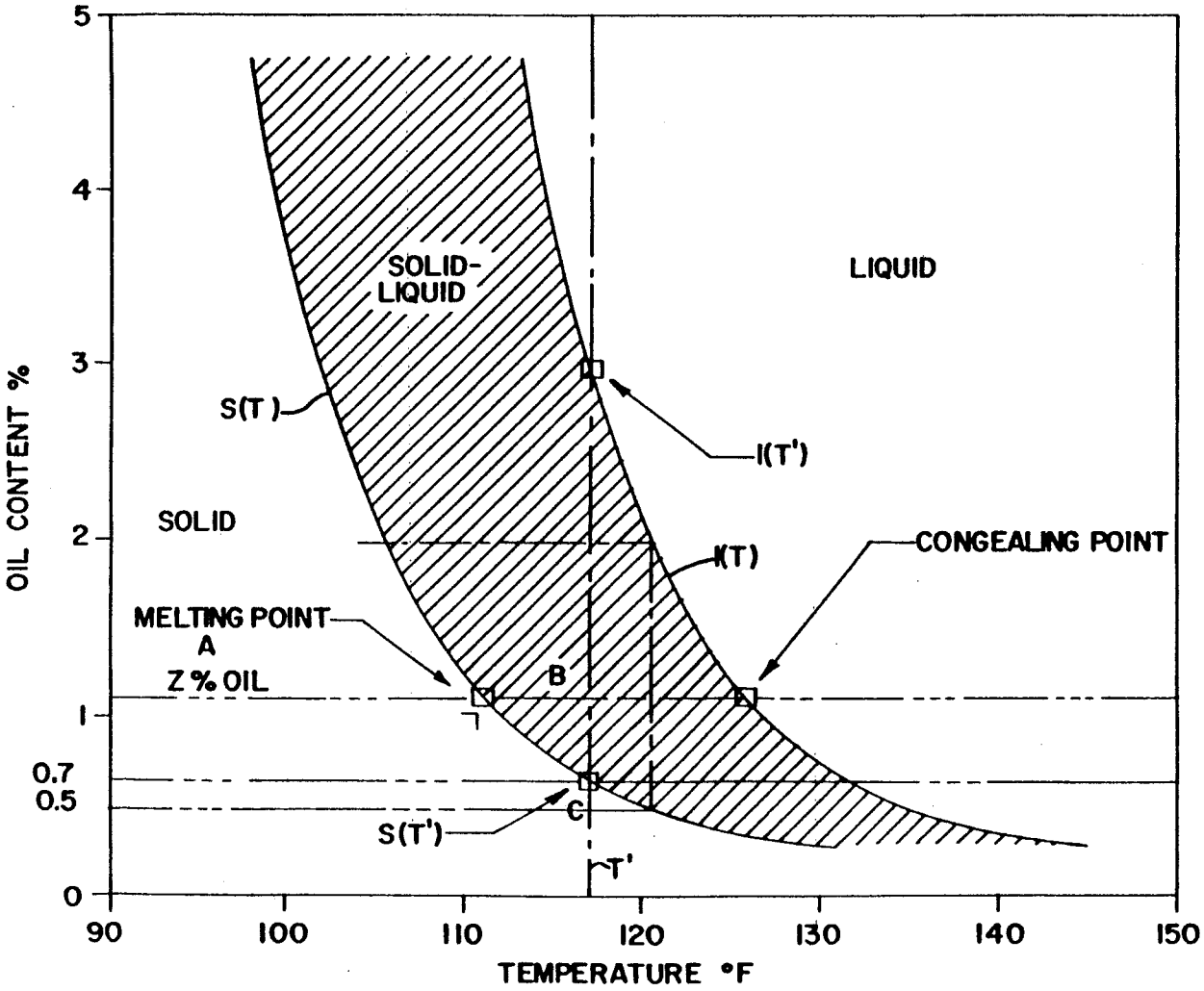
FIG. 3 is an oil-wax phase diagram.

The melting point and/or congealing point of sweated wax can be determined from the oil-wax phase diagram of FIG. 3, if its oil content is known, by extending a horizontal line for the known oil content. The oil content of the bed of solid wax can also be determined on FIG. 3 given the oil content of its equilibrium liquid at any given temperature by extending a vertical line for the known temperature. Accordingly, the oil content, melting point, and congealing point of solid wax can be determined given either the oil content, melting point, or congealing point of the liquid wax in equilibrium with it.

During heating and sweating, the oil content of the liquid drippings (drip stream) roughly follow the 1(T) curve of the oil-wax phase diagram of FIG. 3. If wax could be sweated ideally, that is, every drop of liquid being swept away from the sweating oven 22 the very moment it is formed, the composition of the solid wax remaining in the bed would follow the s(T) curve of FIG. 3. At any given temperature, T, the overall oil content of the wax remaining in the oven would be s(T). The actual practice, however, some of the liquid stays in the pores of the wax bed, thereby increasing the overall oil content of the solid wax. This has the effect of shifting the apparent melting point line to the right of s(T).

Figure 4:
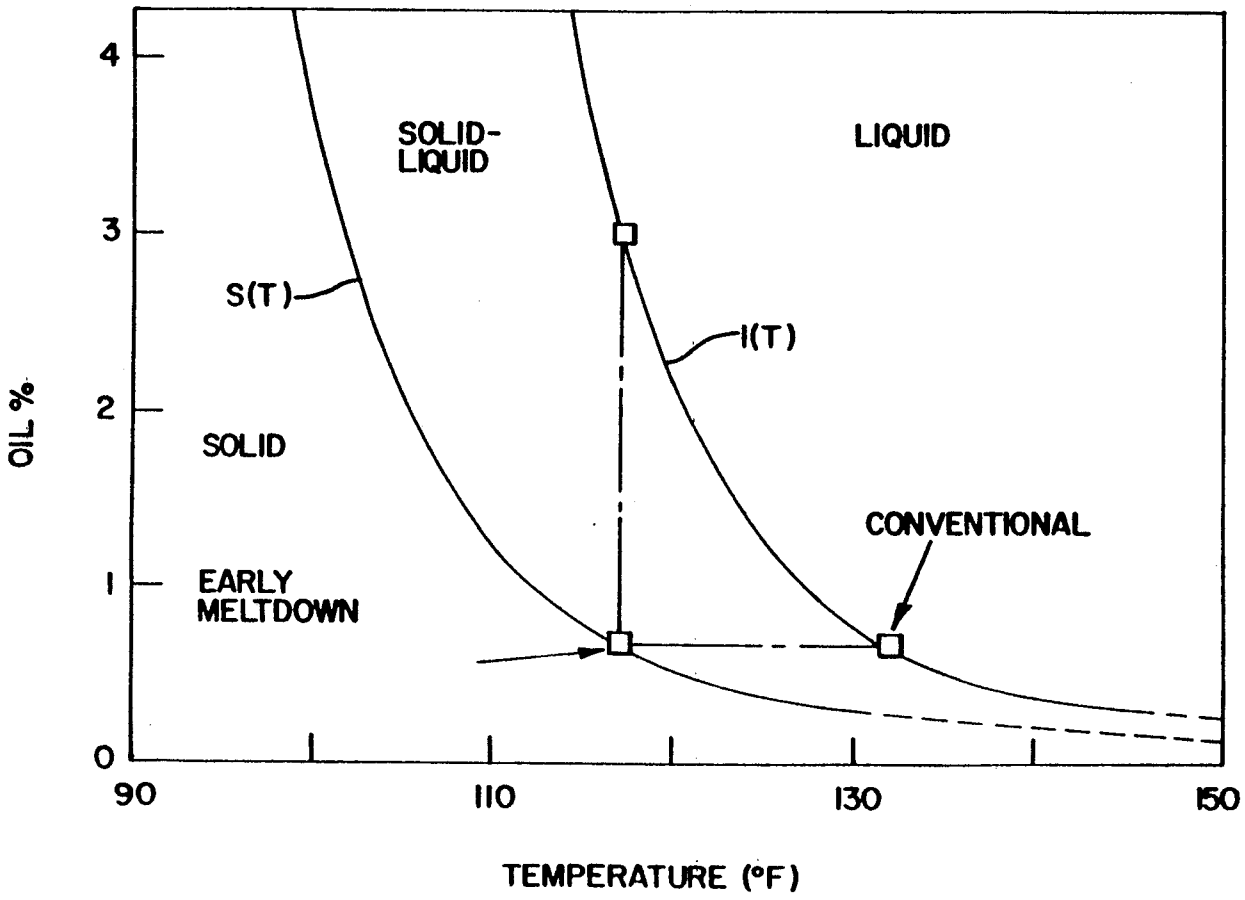
FIG. 4 is another oil-wax phase diagram.

As illustrated in FIG. 4, conventional wax sweating typically recovers wax only through the liquid drips stream. This means that wax must be recycled or discarded until the oven temperature is such that 1(T) is less than the oil content specification for the desired wax product. In the early meltdown method of wax sweating of this invention, however, the solid portion of the wax bed is recovered after it is sweated and early meltdown procedures are initiated. Preferably in the early meltdown sweating process, sweating is stopped when the temperature of the sweating oven 22 is such that s(T), representing the solid/solid-liquid phase boundary and true melting point of the bed of wax, rather than 1(T), representing the liquid/solid-liquid phase boundary and true congealing of the liquid drippings, is below the oil content specification of desired wax product. In actual practice, the final meltdown temperature will typically be slightly higher than s(T).

As shown in FIGS. 3 and 4, the amount of sweating time saved by the early meltdown procedure is proportional to the lateral (horizontal) distance between s(T) and 1(T) at the oil content specification of the desired wax product. For example, at 0.7% oil (the specification maximum for R-25 wax) this distance is about 12° F. on FIGS. 3 and 4. At a sweating rate of 0.5° F./hr., this represents a saving of sweating time of 24 hours for the total sweat cycle. The actual time savings would be slightly less because liquid hold-up in the bed shifts the effective s(T) curve to the right. Since a sweating cycle normally takes five or six days to complete, the novel early meltdown method of wax sweating can decrease the total sweating time by about 16% to about 20%.

The properties of the bed of solid wax remaining in the sweating oven 22 at any time can be determined on an oil-wax phase diagram such as FIG. 3 and the nomograph of FIG. 2 given the properties of the liquid drippings (drips stream) and the extent of liquid hold-up in the bed (sweating efficiency of the sweating oven). The oil-wax phase diagram makes it possible to target a sweat to maximize production of a particular wax before the sweating process begins. By monitoring the liquid drippings (drips stream) from the sweating oven 22, it is possible to know the oil content and melting point of the solid wax remaining in the bed at any time. The oil-wax phase diagrams of FIGS. 3 and 4 indicate when to stop sweating and melt down the wax bed in order to achieve the targeted result. The early meltdown method of wax sweating gives the wax refinery operator more control over production of sweated wax. It allows the refinery to better adjust to changing demands in the wax market place.

The phase boundaries in FIG. 3 can be represented by equations of the form $$s(T)=a_s exp(b_s T)+k$$

and $$l(T)=a_l\, exp(b_l T)+k$$

where s(T) and l(T) are the oil contents of the solid and liquid phases at temperature T. The coefficients as and $a_l$ determine the relative positions of the s(T) and l(T) curves. The exponential coefficients, bs and $b_l$ determine the degree of curvature. These phase boundaries can be determined by analysis with a differential scanning calorimeter (DSC) on waxes of known oil contents. In FIG. 3, curve s(T) can be obtained by plotting the DSC onset temperature versus oil content for samples of sweated wax. Curve l(T) can be obtained by plotting the DSC peak maximum temperature for each wax sample. Of the two curves, l(T) is mcre closely related to the reported melting point of sweated wax since the ASTM melting point procedure actually measures wax congealing point. Both the ASTM melting point and the wax congealing point are usually about 2° F. to about 4° F. less than the DSC peak maximum temperature, l(T), for any given sweated wax.

The ASTM melting point of the final product wax, $T_{fp}$ is related to the congealing point of the oven drips, $T_{dc}$ by the equation:

$$T_{fp} = \left(\frac{1}{b_l}\right)\ln\left[\beta\exp\left(b_l(T_{dc} + \Delta T_c)\right) + \left(\frac{a_s}{a_l}\right)(1-\beta)\exp(b_s(T_{dc} + \Delta T_c))\right] - \Delta T_{ASTM}$$

wherein $T_{fp}$=ASTM melting point of final product wax $T_{dc}$=congealing point of drips at meltdown point $\beta$=liquid hold-up in the wax bed (fraction)

$\Delta T_c$=difference between congealing point and l(T)

$\Delta T_{ASTM}$=difference between ASTM melting point and l(T)

The above equation assumes that $\Delta T_{ASTM}$ is constant and that $\Delta T_c$ is also constant. It also assumes that $\beta$, the liquid hold-up in the bed, is constant throughout the sweat.

The above equation is the foundation of the early meltdown nomograph of FIG. 2. In graphical form, it provides a simple way to determine when to melt down, mix, and pump the final product wax to storage. The early meltdown nomograph of FIG. 2 is based on the phase diagram of FIG. 3. The x-axis (abscissa) of the nomograph of FIG. 2 represents the congealing point of the sweating oven drips stream. The y-axis (ordinate) of the nomograph of FIG. 2 represents the ASTM melting point of the bed of solid wax in the sweating oven 22. The curves on the nomograph of FIG. 2 represent the solutions to the above equation for various values of liquid hold-up. The nomograph shown of FIG. 2 is specific to waxes which have phase diagrams like that of FIG. 3. The preceding equation, however, is relatively insensitive to small changes in the oil-wax phase diagram of FIG. 3. In some situations it is also insensitive to large changes in the oil-wax phase diagram of FIG. 3.

Lateral shifts in the phase diagram of FIG. 3 mani5 fest themselves as changes in the constants $a_s$ and $a_l$ in the preceding equation. If the phase diagram curves, s(T) and l(T), shift to the right or left by the same number of degrees without any change in curvature, then the early meltdown nomograph of FIG. 2 is largely unaffected by the change. If the coefficients $b_s$ and $b_l$ in the preceding equations are equal, then such a shift in the phase diagram, no matter how large, does not materially affect the nomograph of FIG. 2. If s(T) and l(T) shift to the right or left by different amounts, then the ratio of as to $a_l$ in the preceding equation will change. As long as the curvature is nearly the same for both curves, however, $b_s$ and $b_l$ will be nearly equal.

The nomograph of FIG. 2 was constructed assuming that $\Delta T_{ASTM}$ and $\Delta T_c$ are equal. Even if they are not equal, they will effectively cancel each other as long as the curvatures of s(T) and l(T) are nearly equal ($b_s \cong b_l$) Finally, small changes in curvature in the phase diagram do not, in general, translate into large changes in the early meltdown nomograph of FIG. 2.

In order to use the early meltdown nomograph of FIG. 2:

1. Choose the desired ASTM melting point of the target wax. Find this temperature on the y-axis. This represents $T_{fp}$ in the preceding equation.

2. Follow the horizontal line corresponding to the target wax melting point until it intersects the nomograph line corresponding to the oven liquid hold-up (wax sweating efficiency of the sweating oven).

3. Follow a vertical line down from this point of intersection to the x-axis. Read the oven drip congealing point temperature. This represents $T_{dc}$ in the preceding equation.

The early meltdown nomograph of FIG. 2 provides a simple method of determinin9 liquid hold-up (wax sweating efficiency) for any sweating oven. To determine liquid hold-up (wax sweating efficiency), it is only necessary to run an early meltdown sweating procedure and plot the point corresponding to the actual measured values of $T_{fp}$ and $T_{dc}$ on FIG. 2. The plotted point will fall on the curve corresponding to the liquid hold-up for that particular oven. When the drips stream from the sweating oven attains a congealing point equal to $T_{dc}$ then the wax remaining in the bed will have an ASTM melting point of $T_{fp}$.

Advantageously, the carbon number distribution wax produced by the subject early melting process of wax sweating does not differ greatly from that of conventional sweated wax.

Ultraviolet (UV) absorbance of sweated wax is related to the oil content of the wax. To determine the oil content of the wax one can measure the UV absorbance at 264 nm and 400 nm, determine the difference, and apply a linear correlation. This provides a quick and accurate way to determine the oil content of sweated wax. A differential scanning calorimeter (DSC) can also be a valuable tool for characterizing waxes. A DSC can measure the heat capacity of the wax, the heat of a phase transition, such as softening or melting, and the melting point and congealing point temperatures of the wax. By combining DSC melting point data with UV oil content data, an oil-wax phase diagram can be constructed as in FIG. 3. The phase diagram shown in FIG. 3 was obtained by analyzing wax samples of known oil content on a differential scanning calorimeter (DSC). The oil content of each wax sample was obtained by UV absorbance analysis.

Figure 5:
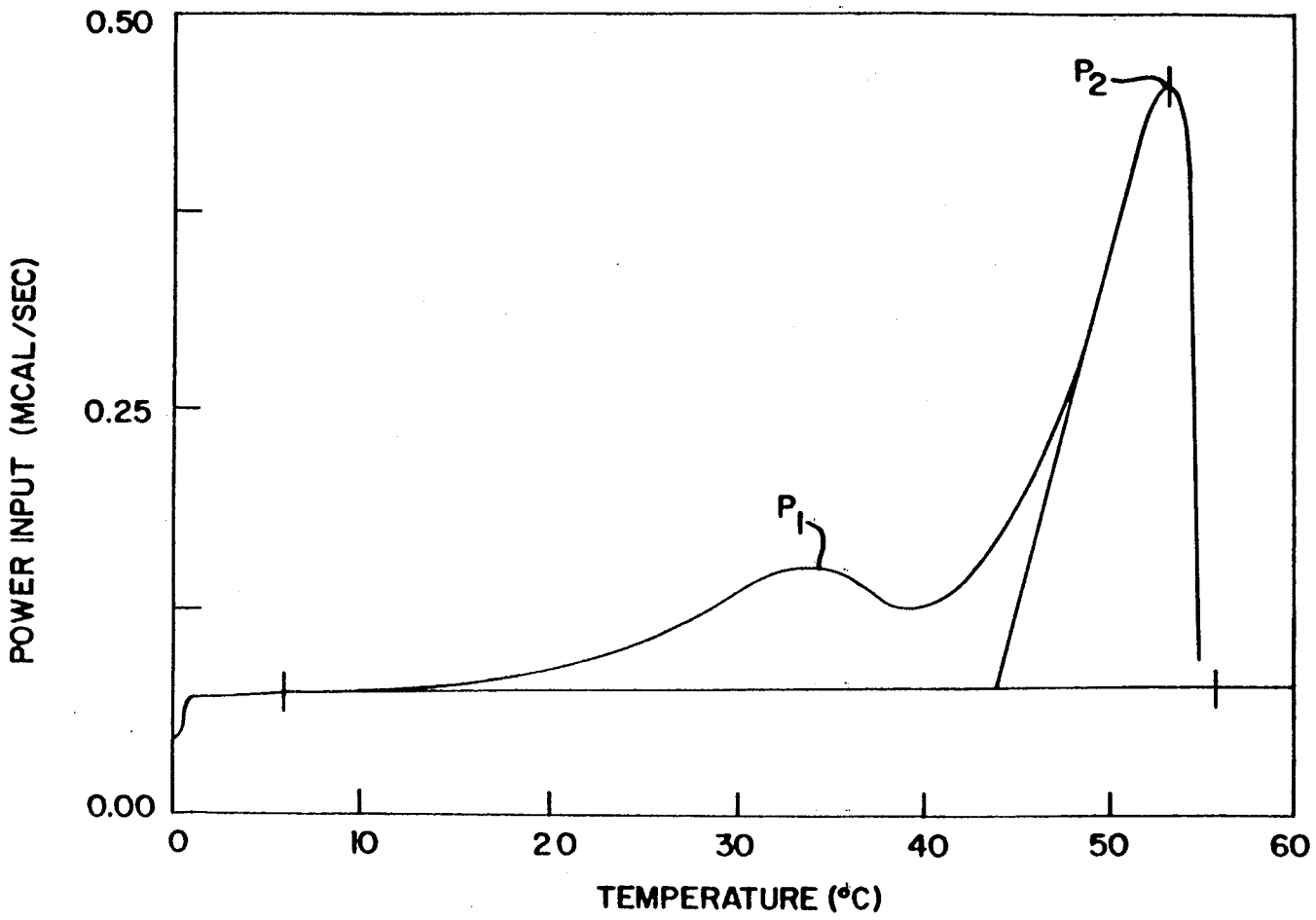
FIG. 5 is a DSC scan of paraffin wax.

FIG. 5 shows a typical DSC scan of paraffin wax. The first small peak P1 is due to the crystal rearrangement that results in wax scfrening. The second peak (taller peak) P2 is due to the melting of the bulk of the wax. The intersection of the leading edge of the melting peak with the peak baseline represents the beginning of melting for the wax sample. The temperature at this point is called the "onset" temperature. The onset temperature can be considered to be the true melting point of the wax. Most of the wax sample melting is complete by the time the peak reaches its maximum. The peak maximum temperature is therefore a good approximation of the true congealing point for the wax. The onset and peak maximum temperatures are the two temperatures that can be plotted versus the sweated wax oil content in order to obtain the oil-wax phase diagram of FIG. 3.

The oil-wax phase diagram shown in FIG. 3 can be obtained by measuring the onset and peak maximum temperatures for waxes of different oil contents. The same diagram could be obtained by measuring the oil content of liquid and solid wax in equilibrium at a given temperature. The oil-wax phase diagram is divided into three sections: solid, solid-liquid, and liquid. In the solid-liquid region, two phases exist simultaneously. At any given temperature in FIG. 3, the values of the corresponding melting point and peak maximum curves represent the oil content of the equilibrium solid and liquid phases, respectively. Each curve can be expressed as a function of temperature. In FIG. 3, the melting point phase boundary can be designated as s(T). The peak maximum phase boundary can be designated as l(T). Furthermore, at any temperature, T*, a vertical tie-line can be drawn between s(T*) and l(T*) and may be used to indicate the relative amounts of liquid and solid in a wax sample. If, for example, the overall composition of the wax sample is z (% oil), and the sample is in the two-phase region, then the mass fraction of the sample which is liquid at T* can be determined by the equation:

$$f_{liq} = \frac{m_{liq}}{m_{tot}} = \frac{z - s(T^*)}{l(T^*) - s(T^*)}$$

Melting of the sample will begin when the temperature is such that s(T)=z and will be completed when l(T)=z.

Current refinery procedures at some refineries often require rejecting sweated wax which is greater than about 0.7 percent in oil content. For example, in the Amoco Oil Company Refinery at Whiting, Ind., if the wax is between 0.7 percent and 0.5 percent oil and if its ASTM melting point is between 122° F. and 127° F., the wax is considered suitable for production as R-25 wax. If the oil content is less than 0.5 percent, then the wax is acceptable as: R-35 wax if the ASTM melting point is between 130°-132° F., or R-40 wax if the ASTM melting point is between 135°-137° F., or CB-39 wax if the ASTM melting point is between 138°-141° F.

The ASTM melting point procedure does not yield the true melting point of the wax. Instead, the ASTM procedure yields a value which is close to the congealing point l(T). Studies with a differential scanning calorimeter (DSC) on samples of R-40 wax indicate that the ASTM melting point may be about 4° F. below the DSC peak maximum temperature. R-40 wax should have an ASTM melting point in the range of 135° F. to 137° F. The DSC peak maximum temperature for six samples of R-40 wax was about 140° F. with a two-sided 95 percent confidence interval of about 2.3° F.

The DSC peak maximum temperature which corresponds to an oil content of 0.7 percent is about 130.5° F. If the ASTM melting point is to be 4° F. lower than the peak maximum temperature, then a sweated wax with 0.7 percent oil would have an ASTM melting point of 126.5° F., making it an R-25 wax. Similarly, a sweated wax with an oil content of 0.5 percent would have an ASTM melting point of 130.6° F., ich is in the range of an R-35 wax.

The oil-wax phase diagram of FIG. 3 indicates that it is unlikely to have a sweated wax which is both high in oil content and high in melting point. The two are inversely related to each other. The oil-wax phase diagram may be specific to the type of crude oil from which the wax is derived. It may also be related to processing upstream of the wax refinery.

As shown in the oil-wax phase diagram of FIG. 3, the wax bed is initially solid wax at a melting point T (Point A). The wax bed is then heated from T to T* (T+ΔT) without removing any liquid (Point B). After equilibrium is reached at T* (T+ΔT), all of the liquid is withdrawn from the bed (Point C). A series of operations such as this represents a stepwise approximation of the subject continuous early meltdown wax sweating process. The following equation is obtained by performing two mass balances on this process, taking the limit as ΔT goes to zero, and integrating from $T_i$ the melting point of the wax charge, to some temperature T:

$$\frac{m}{m_O} = \exp \int_{T_i}^{T} \frac{(ds/dT)}{l(T) - s(T)}\, dT$$

where $m/m_O$ represents the fraction of the original wax charge remaining in the bed at temperature T.

The equations for the solid phase boundary s(T) and the liquid phase boundary l(T) on the oil-wax phase diagram of FIG. 3 are.shown below. The equations are functions of temperature-explicit relationships between s, l, and T, and $m/m_O$. The oil-wax phase diagram approximately follows an exponential relationship with temperature of the form:

$$l(T) \text{ or } s(T) = a\, exp(bT) + k$$

This form of equation for some crude oils and dewaxing efficiencies fits data with a coefficient of determination of greater than 0.97. The equations resulting from a least-squares analysis are:

$$s(T) = 692{,}751\, exp(-0.121957\, T) + 0.2$$

and $$l(T) = 7{,}459{,}340\, exp(-0.126587\, T) + 0.2$$

The general forms of the equations for the phase boundaries are:

$$s(T) = a_s exp(b_s T) + k$$

and $$l(T) = a_l exp(b_l T) + k$$

These forms provide an analytical solution to the previous integral equation. The resulting equation for $m/m_O$ is:

$$\frac{m}{m_O} = \exp\left( -b_s \left( T - T_i - \right.\right.$$

-continued $$\left(\frac{1}{b_l - b_s}\right)\ln\left[\frac{1 - \left(\frac{a_l}{a_s}\right)\exp(b_l - b_s)T}{1 - \left(\frac{a_l}{a_s}\right)\exp(b_l - b_s)\,T_i}\right]\Bigg)\Bigg)$$

where $T_i$ is the true melting point temperature of the original wax charge. This equation is a theoretically-sound analytical expression for the yield of wax as a function of temperature. It represents an ideal wax sweating situation wherein every drop of the liquid wax is removed from the bed as soon as it is formed. It, therefore, indicates the maximum possible yield from a wax sweatin9 operation and mathematically indicates how the oil content of the charge wax affects wax sweating yield.

The previous equation for l(T) gives the oil content of the liquid wax flowing from the bed as a function of temperature. Therefore, the equations for l(T) and $m/m_O$ above can be combined to produce a diagram which represents oil content versus yield of sweated wax.

In actual practice, the liquid drippings do not leave the bed of solid wax and the sweating oven the very moment that the liquid drippings are formed. The liquid drippings spend some time trickling through the bed of solid wax and affect equilibrium in the bed. During sweating, a certain fraction of the wax bed will usually be liquid at any given time. By defining a variable, $\beta$, to be the fraction of the bed that is in the liquid state at any given temperature, then the expression for $m/m_O$ becomes:

$$\frac{m}{m_O} = \exp\left(-b_s(T - T_o) + \left(\frac{\beta b_l + (1-\beta)b_s}{(1-\beta)(b_l - b_s)}\right)\ln\left[\frac{1 - \left(\frac{a_l}{a_s}\right)\exp(b_l - b_s)T}{1 - \left(\frac{a_l}{a_s}\right)\exp(b_l - b_s)\,T_o}\right]\right)$$

where $T_o$ is the temperature at which the bed first contains the fraction of liquid equal to $\beta$. This analysis assumes that $\beta$ is constant throughout the sweating process. The above equation reduces to the simpler ideal form of the previous equation, if $\beta$ is taken to be zero. The above equation is the more general of the two since it considers the effect of charge wax oil content on wax yield and the effect of liquid hold-up fraction on wax yield.

The above equation allows a refinery to realistically model the early meltdown performance of a wax sweating oven. It makes it possible to predict, given the oil-wax phase diagram parameters, how much of the charge wax will be produced as Foots oil, recycle, and sweated wax Hi-Fi feed. The primary parameters which affect the above equation are the characteristics of the phase diagram, the liquid hold-up volume in the sweating ovens, and $T_o$. $T_o$ is a function of the oil content in the slack wax charge. The above equation is applicable not only for the original slack wax charge but for intermediate recycle sweating operations as well.

It is apparent from the oil-wax phase diagram of FIG. 3, that for any given temperature, the solid wax phase always contains less oil than the liquid wax phase. This is one of the principles upon which the early meltdown process of wax sweating is based. The phase diagram of the early meltdown process of FIG. 3 indicates that the solid wax in a sweating oven bed can have an acceptable overall oil content long before the liquid coming from the bed reaches an acceptable oil content.

In FIG. 3, when liquid coming from the bed contains about 2 percent oil, the solid wax remaining in the bed contains only about 0.50 percent oil. If the sweating process was stopped at that point and the remaining solid wax melted down, it would be acceptable as R-35 wax and would have an ASTM melting point of about 130.5° F. If the process was not stopped when the liquid was at 2.0 percent oil, the liquid wax flowing from the bed would not reach the 0.5 percent oil content level until the wax bed was about 15 degrees hotter. There would be less wax in the bed at that time, and it would require about 30 more hours of sweat time at 0.5 degree/hour to reach that point.

As shown in FIG. 3, the oil content of the liquid sweated wax is directly related to the temperature of the system. This relationship is expressed in the previously discussed equation for l(T). The equation can also be used to derive congealing temperature as a function of oil content. Since the congealing temperature is related to the ASTM melting point, the ASTM melting point of a given wax can be determined with the previous equation and FIG. 3 by finding the oil content of the wax. One way to determine the oi content measurement is by UV absorbance. In the oil-wax phase diagram of FIG. 3, if the overall oil content of any given sample can be determined, one can invoke the lever rule to determine how much of the sample is liquid and how much is solid at any temperature.

Two important parameters the refinery can control are: (1) the oil content of the charge wax, which affects the temperature at which liquid wax first starts to flow from the oven; and (2) the efficiency of the oven in discharging liquid when it melts, which is also referred to as liquid hold-up and in the previous equations as the Greek letter beta ($\beta$). It is a measure of the wax bed's tendency to hold liquid in its pores. Beta influences the value of $T_O$. Sweating ovens at refineries typically have liquid hold-up beta values from about 20% to about 30%.

Charge wax with a low oil content gives a higher yield than charge wax with a high oil content. Wax charged to the oven with 2 percent oil can yield roughly 50 percent more acceptable wax than a wax charge with 20 percent oil.

In the oil-wax phase diagram of FIG. 3, the composition of the wax that melts from the ovens during wax sweating follows the liquid phase boundary. It is not considered acceptable as sweated product until it reaches a low oil conten and corresponding high melting point. The phase diagram illustrates, however, that the solid wax in the bed can be acceptable as sweated product when the liquid is still fairly rich in oil.

In the early meltdown process of wax sweating, sweating operations are stopped early, the remaining bed of solid wax is melted down, collected, and hydrofinished. The wax produced in this way is better than conventionally sweated wax obtained at a much higher oven temperature. In the nomograph of FIG. 2, the operator chooses the ASTM melting point of the desired target wax, finds where the line intersects the correct liquid hold-up line, and drops down to the x-axis to find the correct meltdown temperature. This nomograph makes the early meltdown procedure easier to implement. Also, the early meltdown nomograph gives a one-point method of determining sweating oven efficiency.

The early meltdown procedure is capable of saving as much as 18 to 24 hours or more out of a 5- or 6-day sweat. That amounts to a time savings of at least about 15 percent. The early meltdown procedure also lends flexibility to the process of sweating wax. Furthermore, the early meltdown wax sweating process makes it possible to choose the characteristics of the final product wax before the sweating operation even begins.

The early meltdown procedure has many advantages over conventional sweating. It is flexible, making it possible to customize wax production to the changing demands of the marketplace. It also reduces sweating time and increases productivity. It further expands the maximum capacity of the wax refinery. Moreover, it enhances the efficiency and economy of wax sweating.

Significantly, the early meltdown method of wax sweating reduces the time required to sweat wax. Conventional sweating requires that the oven temperature be raised slowly until all of the wax has melted. In the early meltdown method of wax sweating, however, the slow heating (sweating) cycle is interrupted and stopped when monitoring of the liquid drippings (drips stream) indicates that the solid bed of wax remaining in the sweating oven has the desired properties of the final wax product. Then the sweating oven is shut-in, the drain valve closed, and the sweating oven is heated at a rate substantially faster than the sweating rate to melt the wax remaining in the sweating oven as quickly as possible. This early interruption in one normal sweating cycle can save as much as 50% of the actual sweating time and 30% of the overall time, which includes charging, cooling, etc. Advantageously, the time savings achieved by the early meltdown method of wax sweating substantially increases production volumes and throughput for each sweating oven.

The early meltdown method of wax sweating allows the operator to decide what type of wax will be produced from a given sweat before the wax is even charged to the oven. This is one of the many advantages of the early meltdown method of wax sweating, because it allows wax refinery personnel to tailor wax production to meet inventory requirements and market demand. Desirably, the early meltdown method of wax sweating can allow the operator to produce one particular type of wax from each sweat. Conventional sweating, on the other hand, produces largely-unpredictable amounts of several types of wax during every sweating operation which makes it extremely difficult to control the desired wax product.

Advantageously, the early meltdown method of wax sweating is also simple to operate, easy to use, safe, and requires only minimal training for refinery personnel.

The early meltdown process of wax sweating as described in the Specification and recited in the claims has been implemented at the Amoco Oil Company Refinery in Whiting, Ind. and has met with substantial commercial success. The quality, oil content, and ASTM melting temperature of the wax product produced at the Amoco Oil Company Refinery has been more accurately controlled with the early meltdown process of wax sweating. The early meltdown method of wax sweating substantially enhances the efficiency, effectiveness, yield, and economy of wax sweating at the Amoco Oil Company Refinery. Furthermore, turnaround time of wax sweating at the Amoco Oil Company Refinery in Whiting, Ind., has been greatly increased.

Although embodiments of this invention have been shown and described, it is to be understood that various modifications and substitutions, as well as rearrangements of process steps, can be made by those skilled in the art without departing from the novel spirit and scope of this invention.

What is claimed is:

1. A wax sweating process, comprising the steps of:

solidifying molten wax containing oil to crystallize said wax;

sweating said solidified wax to produce sweated wax containing less oil than said molten wax, said sweating including gradually and progressively heating said solidified wax is a sweating oven to at least its melting point; while withdrawing liquid drippings comprising some of said wax and oil from said sweating oven;

determining the relationship of the melting point of the remaining solidified wax in said sweating oven as a function of the congealing point of said liquid drippings and the efficiency of said sweating oven;

monitoring the congealing point of said liquid drippings as said solidified wax in said sweating oven is being heated;

determining the melting point of the remaining solidified wax is said sweating oven based upon said monitored congealing point and said determined relationship of said melting point of the remaining solidified wax as a function of the congealing point of said liquid drippings and the efficiency of said sweating oven;

ceasing sweating of the remaining solidified wax in said sweating oven and withdrawal of said liquid drippings from said wax sweating oven when said melting point of the remaining solidified wax in said sweating oven reaches the desired wax product; thereafter heating said oven to melt the remaining solidified wax without substantially deoiling and separating liquid drippings from said wax to liquify and produce the desired wax product; and discharging said melted wax product from said sweating oven.

2. A wax sweating process in accordance with claim 1 including collecting said melted wax product in a container selected from the group consisting of a pan, vessel, tank, bin, receptacle, pipe, drum, and kettle.

3. A wax sweating process in accordance with claim 1 wherein said sweating includes fractionating said solidified wax into waxes having different melting points.

4. A wax sweating process in accordance with claim 1 wherein said determining said relationship includes graphing the relationship of the ASTM melting point of the remaining solidified wax in said sweating oven as a function of the congealing point of said liquid dripping and the efficiency of said sweating oven.

5. A wax sweating process in accordance with claim 4 wherein said graphing includes preparing a nomograph having one axis comprising the congealing point of said liquid drippings and another axis comprising the ASTM melting point of the remaining solidified wax in said sweating oven.

6. A wax sweating process in accordance with claim 5 wherein said ASTM melting point of the remaining solidified wax is said sweating oven is determined by linearly intersecting the monitored congealing temperature of said liquid drippings observed on said thermometer with said nomograph, drawing a substantially straight line from said intersection to said axis comprising the ASTM melting point of said remaining solidified wax in said sweating oven, and observing the ASTM melting point where said straight line crosses said axis.

7. A wax sweating process in accordance with claim 1 wherein said determining said relationship includes calculating said relationship on a computer or calculator in accordance with the following formula:

$$T_{fp} = \left(\frac{1}{b_l}\right)\ln\left[\beta\exp\left(b_l(T_{dc} + \Delta T_c)\right) + \left(\frac{a_s}{a_l}\right)(1-\beta)\exp(b_s(T_{dc} + \Delta T_c))\right] - \Delta T_{ASTM}$$

wherein:

$T_{fp}$ is the ASTM melting point of the bed of solidified wax in the oven during sweating;

$T_{dc}$ is the congealing point of the liquified wax;

$\beta$ is the liquid holdup in the bed of wax or the efficiency of the sweating oven.

$\Delta R_c$ is the difference between the congealing point and the peak maximum temperature of the wax measured by a differential scanning calorimeter;

$\Delta T_{ASTM}$ is the difference between the ASTM melting point and the peak maximum temperature of the wax measured by a differential scanning calorimeter;

ln is a natural log;

exp is Euler's number (2.71828);

The solid phase boundary of the wax is determined by the equation:

$$s(T) = a_{se}b_sT + k$$

The liquid phase boundary of the wax is deLermined by the equation:

$$l(t) = a_{le}b_lT + k$$

$a_s$ is a coefficient of the equation of the solid phase boundary of the wax;

$a_l$ is a coefficient of the equation of the liquid phase boundary of the wax;

$b_s$ is another coefficient of the equation of the solid phase boundary of the wax;

$b_l$ is another coefficient of the equation liquid phase boundary of the wax;

T is the temperature of the solid and liquid pnases of the wax in equilibrium;

e is Euler's number (2.71828); and k is a constant.

8. A wax sweating process in accordance with claim 1 wherein said monitoring comprises:

placing some of said liquid drippings on a thermometer;

rotating said thermometer until said liquid drippings begin to congeal; and observing the congealing temperature of said liquid drippings on said thermometer.

9. A wax -weating process in accordance with claim 1 including:

measuring the onset and peak maximum temperatures of said liquid drippings and the melting point of said liquid drippings with a differential scanning calorimeter;

measuring the oil content of said liquid drippings by ultraviolet absorbance; and plotting said measured melting points, congealing points, and oil content on a graph having one axis comprising temperature and another axis comprising oil content to construct an oil-wax phase diagram.

10. A wax sweating process in accordance with claim 9 including linearly intersecting the ASTM melting point of the remaining solidfied wax in said sweating oven with the plot of said oil-wax phase diagram; drawing a substantially straight line from asid point of intersection to said axis comprising said oil content on said oil-wax phase diagram; and observing the point where said straight line intersects said axis comprising said oil content to determine the proportion of oil in said remaining solidified wax in said sweating oven.

* * * * *

UNITED STATES PATENT OFFICE

CERTIFICATE OF CORRECTION

Patent No. 5,015,357 Dated MAY 14, 1991

Inventor(s) ROGER M. RUEFF

It is certified that error appears in the above-identified patent and that said Letters Patent is hereby corrected as shown below:

| Col. | Line | |
|---|---|---|
| 5 | 68 | "The" should read ---In--- |
| 6 | 66 | "as" should read ---$a_s$--- |
| 7 | 8 | "mcre" should read ---more--- |
| 7 | 57 | "mani5" should read ---mani- --- |
| 7 | 68 | "as" should read ---$a_s$--- |
| 8 | 24 | "determinin9" should read ---determining--- |
| 8 | 59 | "scfrening" should read ---softening--- |
| 9 | 67 | "ich" should read ---which--- |
| 11 | 15 | "sweatin9" should read ---sweating--- |
| 12 | 58 | "conten" should read ---content--- |
| 14 | 20 | "is" should read ---in--- |
| 14 | 32 | "is" should read ---in--- |
| 15 | 13 | "re1ationship" should read ---relationship--- |
| 15 | 25 | "me1ting" should read ---melting--- |

UNITED STATES PATENT OFFICE

CERTIFICATE OF CORRECTION

Patent No. 5,015,357 Dated MAY 14, 1991

Inventor(s) ROGER M. RUEFF

It is certified that error appears in the above-identified patent and that said Letters Patent is hereby corrected as shown below:

| Col. | Line | |
|---|---|---|
| 15 | 30 | "$\Delta R_c$" should read ---$\Delta T_c$--- |
| 15 | 44 | "deLermined" should read ---determined--- |
| 16 | 9 | "equation liquid" should read ---equation of the liquid--- |
| 16 | 11 | "pnases" should read ---phases--- |
| 16 | 23 | "-weating" should read ---sweating--- |
| 16 | 37 | "including" should read ---including:--- |
| 16 | 40 | "asid" should read ---said--- |

Signed and Sealed this

First Day of February, 1994

Bruce Lehman

*Attest:*

BRUCE LEHMAN

*Attesting Officer*

*Commissioner of Patents and Trademarks*